US007111751B2

(12) United States Patent
Copley et al.

(10) Patent No.: US 7,111,751 B2
(45) Date of Patent: Sep. 26, 2006

(54) PLASTIC LINED CONCRETE TANKS EQUIPPED WITH WATERSTOP SYSTEMS

(75) Inventors: James D. Copley, Gainesville, FL (US); Clark Gunness, Newbury, NH (US)

(73) Assignee: The Crom Corporation, Gainesville, FL (US)

( * ) Notice: Subject to any disclaimer, the term of this patent is extended or adjusted under 35 U.S.C. 154(b) by 399 days.

(21) Appl. No.: 10/457,721

(22) Filed: Jun. 9, 2003

(65) Prior Publication Data

US 2004/0245255 A1 Dec. 9, 2004

(51) Int. Cl.
*B65D 90/02* (2006.01)

(52) U.S. Cl. ..... 220/565; 220/3.4; 52/396.05

(58) Field of Classification Search ..... 220/651, 220/652, 653, 565, 648, 3.4, 683; 52/302.1, 52/302.3, 302.4, 287.1, 288.1, 169.6
See application file for complete search history.

(56) References Cited

U.S. PATENT DOCUMENTS

| | | | | |
|---|---|---|---|---|
| 2,865,267 | A | 12/1958 | Bailey | |
| 2,932,964 | A | 4/1960 | Dobell | |
| 2,937,065 | A | 5/1960 | Harza | |
| 3,092,933 | A * | 6/1963 | Closner et al. | 52/223.2 |
| 3,172,237 | A | 3/1965 | Bradley | |
| 3,280,525 | A | 10/1966 | Crowley | |
| 3,340,126 | A * | 9/1967 | Knight | 156/281 |
| 4,041,665 | A | 8/1977 | de Munck | |
| 4,098,047 | A | 7/1978 | Weber | |
| 4,271,647 | A | 6/1981 | Balck, Jr. | |
| 4,287,691 | A * | 9/1981 | Guenther | 52/97 |
| 4,333,662 | A | 6/1982 | Jones | |
| 4,622,784 | A | 11/1986 | Black et al. | |
| 5,349,797 | A | 9/1994 | Stultz | |
| 5,628,857 | A * | 5/1997 | Baerveldt | 156/244.25 |
| 6,431,387 | B1 * | 8/2002 | Piehler | 220/495.01 |

* cited by examiner

*Primary Examiner*—Stephen K. Cronin
*Assistant Examiner*—Eugene Lhymn
(74) *Attorney, Agent, or Firm*—James H. Marsh, Jr.; Stinson Morrison Hecker LLP

(57) ABSTRACT

A plastic lined concrete tank includes a floor, an upright wall having a lower edge adjacent the floor, a plastic wall lining on an interior surface of the wall, and a plastic waterstop structure inhibiting penetration of water between said floor and said lower edge of the wall. The waterstop includes an anchor embedded in the floor and an upper flange which overlaps the lining. A sealed joint is provided between the upper edge of the flange and the lining. The flange and the lining are fused together to form a supporting structure at a position lower on the wall than the sealed joint, whereby outward bending of the flange away from the wall lining at said joint during shifting of the wall relative to the floor is inhibited and outward bending of the flange away from the wall lining at a location remote from said joint during shifting of the wall relative to the floor is promoted. The tank also includes a plastic floor liner and a floor liner attachment member fused to said anchor. The attachment member is attached in sealing relationship to the floor liner.

26 Claims, 4 Drawing Sheets

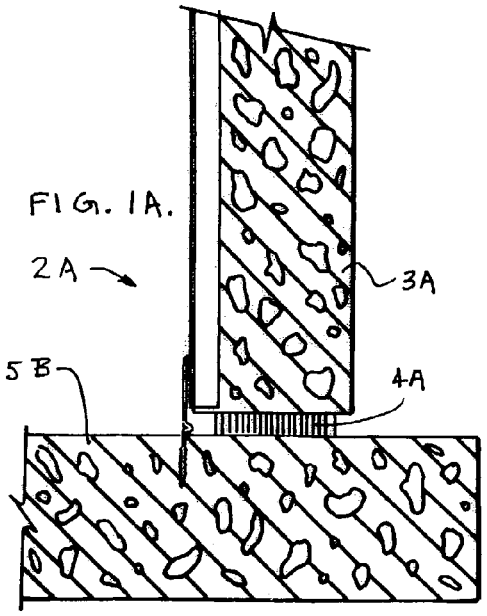
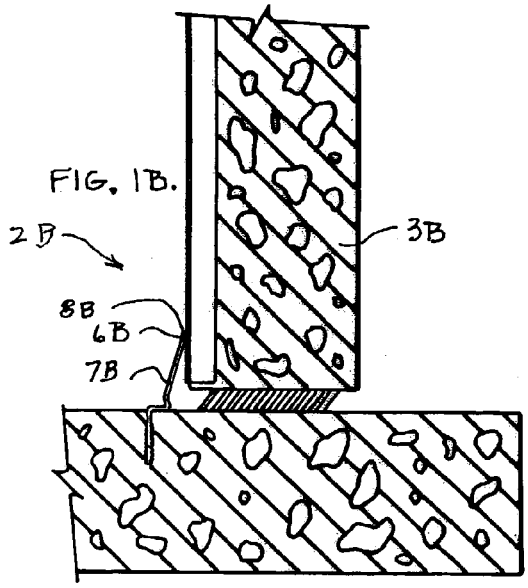
PRIOR ART
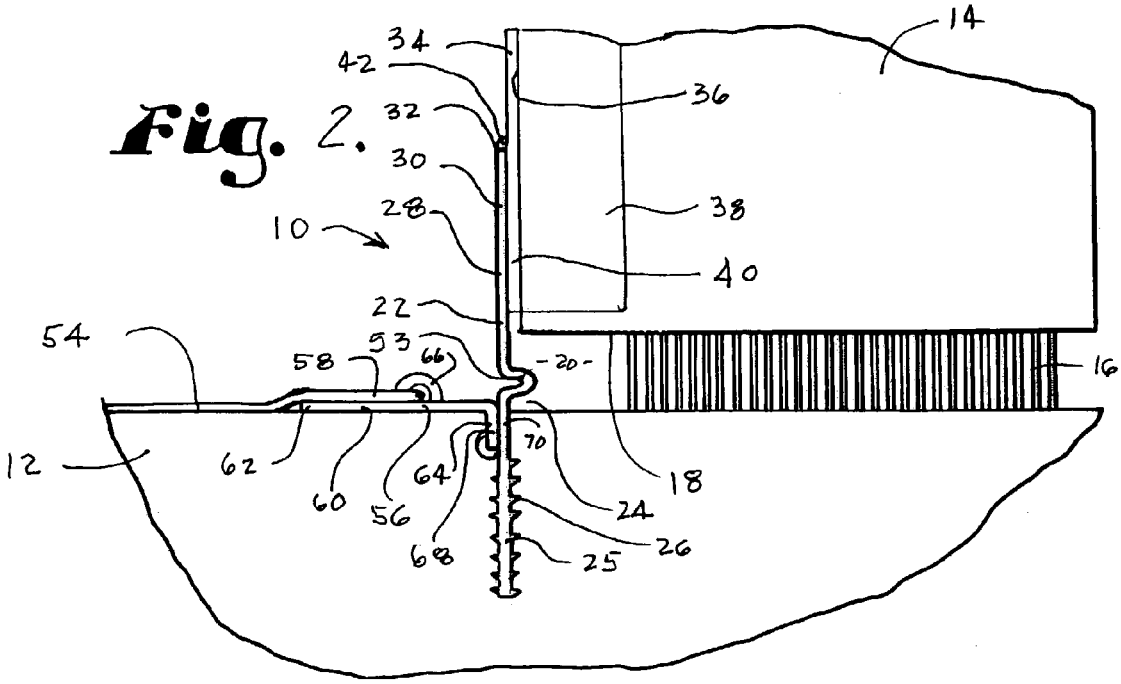

PLASTIC LINED CONCRETE TANKS EQUIPPED WITH WATERSTOP SYSTEMS

CROSS REFERENCE TO RELATED APPLICATION

None

BACKGROUND OF THE INVENTION

1. Field of the Invention

The present invention relates generally to the field of ground level concrete tanks which are used primarily to hold water, and in particular the present invention relates to plastic lined concrete tanks equipped with waterstop systems to inhibit penetration and leakage of the contents of the tank between the tank foundation and the bottom edge of an upright wall.

2. The Prior Art Background

Waterstop systems are well known standard materials used in the ground level concrete tank construction industry to prevent the contents such as water, etc. from penetrating through the joints at the base of the tank where the walls meet the floor. Normally, waterstop systems are anchored directly in the concrete or adhered or fastened directly to the surface of the concrete in concrete structures. Known waterstop systems recognize the fact that concrete structures can experience significant movement at the joints, for example, the joint between the bottom edge of an upright wall and the floor, in response to changes in liquid level, climatic cycles, environmental changes and the like, and so waterstop systems are commonly made from various types of plastic and rubber for flexibility. However, in the case of plastic lined concrete tanks, there has been no good solution to problems encountered particularly when a waterstop system is anchored in the concrete floor and then must be permanently sealed to a plastic lining on a tank wall to prevent leakage. The problem is that the tank walls cycle (expand and contract) with changes in temperature and liquid levels in the tank, and the waterstop system must contort to accommodate the resultant movement. Such contortion often ruptures or otherwise violates (i.e., compromises the projected lifespan of) the primary seal between the lining and the waterstop system.

In addition, with known tank lining systems, plastic floor liners must generally be secured at their peripheral edges using bolts or other forms of fastening. This is expensive and often unreliable, since the bolts must be gasketed with another material, generally a foamed rubber, to make them watertight.

SUMMARY OF THE INVENTION

The foregoing problems inherent in prior art systems are alleviated, if not eliminated entirely, through the use of the concepts and principles of the present invention. In this regard, the invention provides a plastic lined concrete tank which includes a novel and efficient waterstop system that facilitates the formation of permanent, long lasting primary seals at the waterstop/wall lining interface to prevent penetration of the contents of the tank into the joints at the base of the lined walls of the tank. In accordance with one preferred aspect of the invention, the tank comprises a floor, a horizontally elongated upright wall having a lower edge disposed adjacent to said floor, a plastic wall lining disposed on an interior surface of the wall, and a horizontally elongated plastic waterstop structure inhibiting penetration of water between said floor and said lower edge of the wall.

In further accordance with the invention, the waterstop structure desirably may include an anchor attached to the floor adjacent the wall and an upwardly extending flange including an upper attachment segment. The upper attachment segment of the flange and a lower attachment portion of the wall lining are disposed in overlapping relationship relative to one another. The upper attachment segment of the flange has an upper edge attached in sealing relationship to the wall lining so as to present an elongated sealed joint which extends along said upper edge in a lateral direction across the wall lining and in general parallelism relative to the floor. In accordance with this preferred aspect of the invention, an area of a surface of the upper attachment segment of the waterstop flange and a facing area of a surface of the lower attachment portion of the wall lining are interconnected to form a supporting structure at a position lower on the wall than the sealed joint. Thus, outward bending of the flange away from the wall lining at the sealed joint during shifting or movement of the wall relative to the floor is inhibited and outward bending of the flange away from the wall lining at a location remote from the joint during shifting or movement of the wall relative to the floor is promoted.

Desirably, the upper attachment segment of the waterstop flange is disposed in overlying relationship relative to the lower attachment portion of the wall lining, whereby the interconnected surface of the upper attachment segment of the flange is an inner surface, and the interconnected surface of the lower attachment portion of the lining is an outer surface.

Preferably, in further accord with the principles and concepts of the invention, a lower portion of the anchor may be embedded in the floor of the tank as the latter is poured. Alternatively, the lower end may be grouted into a channel cut in the floor of the tank or otherwise attached to the concrete floor, for example, by bolting, or adhering or the like.

Ideally, the aforementioned support structure may comprise a bending resistant horizontally extending band that is formed by fusing together plastic materials of the upper attachment segment of the flange and the lower attachment portion of the wall lining. The band may have a substantial vertical width, such as, for example, a vertical width ranging from about ½ inch to about 6 inches. In further accord with the concepts and principles of the invention, the joint may comprise a primary seal between the wall ling and the waterstop in the form of a horizontally elongated plastic weld bead.

In accordance with another very important aspect of the invention, the same may provide a plastic floor liner on an upper surface of the floor and a floor liner attachment member connected to the waterstop anchor. The attachment member may desirably include a generally horizontally extending tab section having a distal edge portion attached in sealing relationship to a lateral attachment portion of the floor liner. The attachment member may desirably include a connector flap that extends downwardly from said horizontally extending tab and is attached to the anchor. Ideally, a sector of the connector flap may be fused to a corresponding sector of the anchor and the sectors may be embedded in or otherwise attached to the floor.

In another aspect, the invention provides a method for sealing a plastic lined concrete tank comprising a generally horizontal floor, a horizontally elongated upright wall, and a plastic wall lining disposed on an interior surface of the wall.

In accordance with this aspect of the invention, the method may include providing a waterstop structure including an anchor and an upwardly extending flange having an upper attachment segment presenting an upper edge, attaching the anchor to the floor adjacent the interior of the wall, installing the upper attachment segment of the flange such that it and a lower attachment portion of the lining are disposed in overlapping relationship, sealing the upper edge of the upper attachment segment to the wall lining so as to present an elongated sealed joint which extends along the upper edge of the attachment segment in a lateral direction across the wall lining, and interconnecting an area of a surface of the upper attachment segment and a facing area of a surface of the lower attachment portion to form a supporting structure at a position lower on the wall than the sealed joint, whereby outward bending of the flange away from the wall lining at the joint during shifting or movement of the wall relative to the floor is inhibited and outward bending of the flange away from the wall lining at a location remote from the joint during shifting or movement of the wall relative to the floor is promoted.

Desirably, the upper attachment segment of the flange may be installed in overlying relationship relative to the lower attachment portion of the wall lining, the surface of the upper attachment segment of the waterstop flange may be an inner surface, and the surface of the lower attachment portion of the wall lining may be an outer surface.

Ideally, in accordance with this aspect of the invention, the supporting structure may be formed by fusing together the plastic materials of the flange and the lining.

In yet another important aspect, the invention provides a method for preventing bending along a horizontal sealed joint between a plastic lining on a wall of a tank which shifts during use and an upright flange of a plastic waterstop. In accordance with this aspect of the invention, the method includes providing a lower attachment portion on the plastic lining beneath the joint, and interconnecting an area of the attachment portion of the lining to an area of an upper attachment segment of the flange to form a supporting structure at a position lower than the joint, whereby the flange bends at a location adjacent a lower edge of the supporting structure rather than at the joint during shifting of the wall. Ideally, the upper attachment segment of the waterstop flange may initially overlie the lower attachment portion of the plastic wall lining, and the supporting structure may be formed by fusing together the plastic materials of the waterstop flange and the wall lining.

BRIEF DESCRIPTION OF THE DRAWINGS

FIGS. 1A and 1B are elevational cross-sectional views illustrating the operation of prior art waterstops;

FIG. 2 is an enlarged partial elevation cross-sectional view illustrating a tank including a waterstop which embodies the principals and concepts of the invention;

DETAILED DESCRIPTION OF THE PREFERRED EMBODIMENTS

Figure 3B:
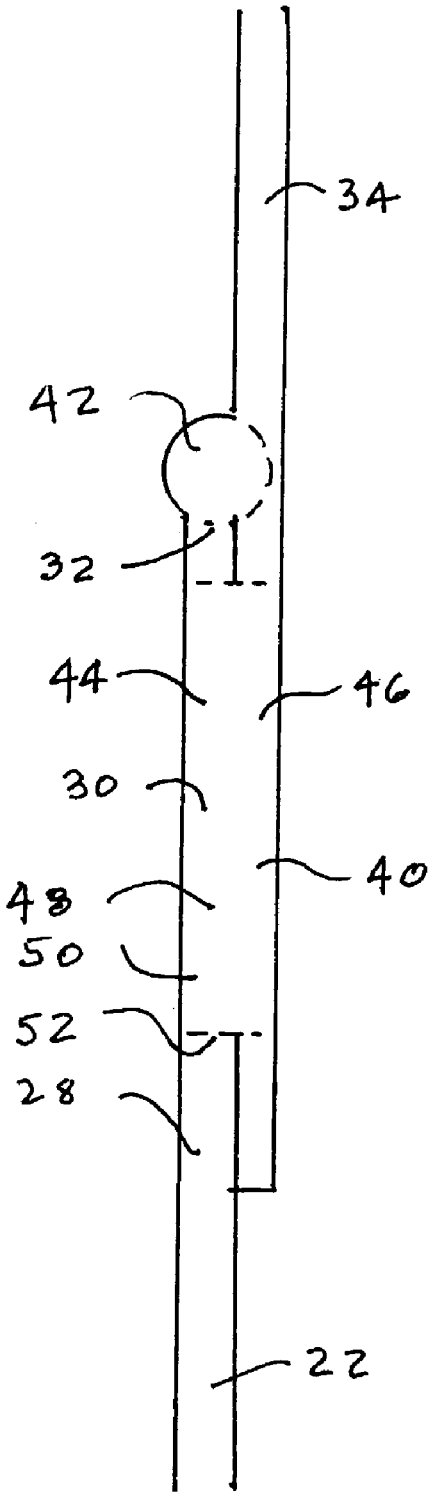
FIGS. 3A and 3B are enlarged fragmentary elevational cross-sectional views showing the details of the interconnection between the waterstop and the plastic lining on the wall of the tank of FIG. 2.

In large concrete structures, such as water tanks or the like, the vertical walls are constructed separately from the floor and such tanks tend to leak through voids created between the bottom of the walls and the floor. In some instances such leakage may be inhibited by providing waterstops intended to provide a seal between the wall and the floor. Such devices need to be flexible to accommodate shifting of the walls laterally across the floor in response to atmospheric conditions and water load in the tank. As a result, the waterstops are commonly made from various types of plastic and rubber. However, special problems are presented in connection with plastic lined tanks where there has been no good solution for the problems created as a result of the necessity for the waterstop to be anchored rigidly in the concrete floor and yet a long-lasting primary seal must be provided between the waterstop and the plastic lining on a wall which shifts laterally during its use. The problem is that when the tank walls shift with temperature changes and liquid level in the tank, the waterstop contorts to accommodate this movement and this contortion places a great deal of stress on the primary seal between the waterstop and the plastic lining, which stress often results in rupturing of the primary seal between the waterstop and the wall lining. This problem is illustrated in FIGS. 1A and 1B which show a prior art tank 2A with its upright wall 3A in a normal position atop a flexible bearing pad 4A resting on a floor 5B (FIG. 1A) and a prior art tank 2B with its upright wall 3B in a shifted position (FIG. 1B). As can be seen from FIG. 1B, when the wall 3B is in its shifted position, the upper end 6B of the waterstop 7B twists about the horizontal axis of the primary seal 8B, and often, as a direct result of such twisting, the seal 8B is broken, violated and/or otherwise damaged. The present invention operates to cause the flange of the waterstop to bend at a location which is remote from the seal during shifting of the wall, thereby isolating the seal from the destructive forces present in prior art installations.

A portion of a plastic lined concrete tank 10 which embodies the concepts and principles of the invention is shown in FIG. 2. The tank 10 desirably includes a generally horizontal concrete floor 12 and an upright wall 14 which sits on a flexible bearing pad 16 positioned between the lower edge 18 of the wall 14 and the floor 12. It is pointed out in connection with the bearing pad 16 that such items are well known and conventionally used in the tank construction field.

In accordance with the concepts and principles of the invention, the wall 14 may be constructed as a tilt-up panel which is formed complete with lining and then tilted up into place or as a shotcrete or cast wall which is formed in place. In the latter case, the wall may comprise a series of side-by-side panels or a continuous wall. That is to say, the wall 14 may be any kind of wall that is known in the concrete tank construction field. As used in this specification, the term wall is intended to encompass wall panels which are arranged in side-by-side relationship as well as continuous walls which extend continuously around the periphery of a tank. As is well understood by those who are routineers in the concrete tank art, the wall 14 is elongated in a horizontal direction (into and out of the plane of the drawing of FIG. 2).

The lower edge 18 of the wall 14 is disposed adjacent the floor 12, and it is common knowledge in the art that the contents of a tank such as the tank 10 may tend to penetrate into the area 20 between the lower edge 18 of the wall 14 and the floor 12 unless a device such as a waterstop is employed. Accordingly, the tank 10 is provided with a waterstop structure 22 which is positioned inside the tank 10 and which is designed to prevent penetration of the contents of the tank into the area 20. In accordance with the concepts and principles of the invention, the waterstop structure 22 is desirably constructed of a flexible plastic material, and the same is elongated and installed in such a way that it extends in a horizontal direction along the junction point 24 between the floor and the lower edge 18 of the wall 14.

As can be seen viewing FIG. 2, waterstop structure 22 desirably includes an anchor 25 which is attached to the floor 12 adjacent the lower edge 18 of the wall 14. Preferably, although not critically, the anchor 25 may be embedded in the concrete of the floor 14 when the latter is poured. Alternatively, the anchor 25 may be grouted into a channel cut in the floor 14 or otherwise affixed to the concrete floor 14, such as by bolting or the like. Additionally, the anchor 25 may desirably be provided with a series of outwardly extending ribs or protrusions 26 which assist in holding the anchor 25 in the floor 12. As can also be seen from FIG. 2, waterstop structure 22 may also desirably include an upwardly extending flange 28 having an upper attachment segment 30 and an upper edge 32.

The tank 10 is further provided with a plastic wall lining 34 that covers the interior surface 36 of the wall 14. Desirably, the lining 34 may include a series of elongated anchoring ribs 38 which are embedded in the concrete of the wall 14 as it is formed. Only one of these ribs is shown in FIG. 2, however, these ribs 38 are known in the art and those skilled in the art will appreciate that the same are generally parallel arranged in spaced apart relationship in a direction along the wall 14. These ribs 38 assist in securing the lining 34 to the wall 14 and holding the lining 34 in place during use of the tank 10. Although ribs such as the ribs 38 may be the preferred means for holding the lining 34 in place on the wall 14, other known means, such as a multiplicity of regularly spaced discrete anchors dispersed across the face of the wall liner may be used in the alternative for holding the lining against the surface of the wall.

Figure 4:
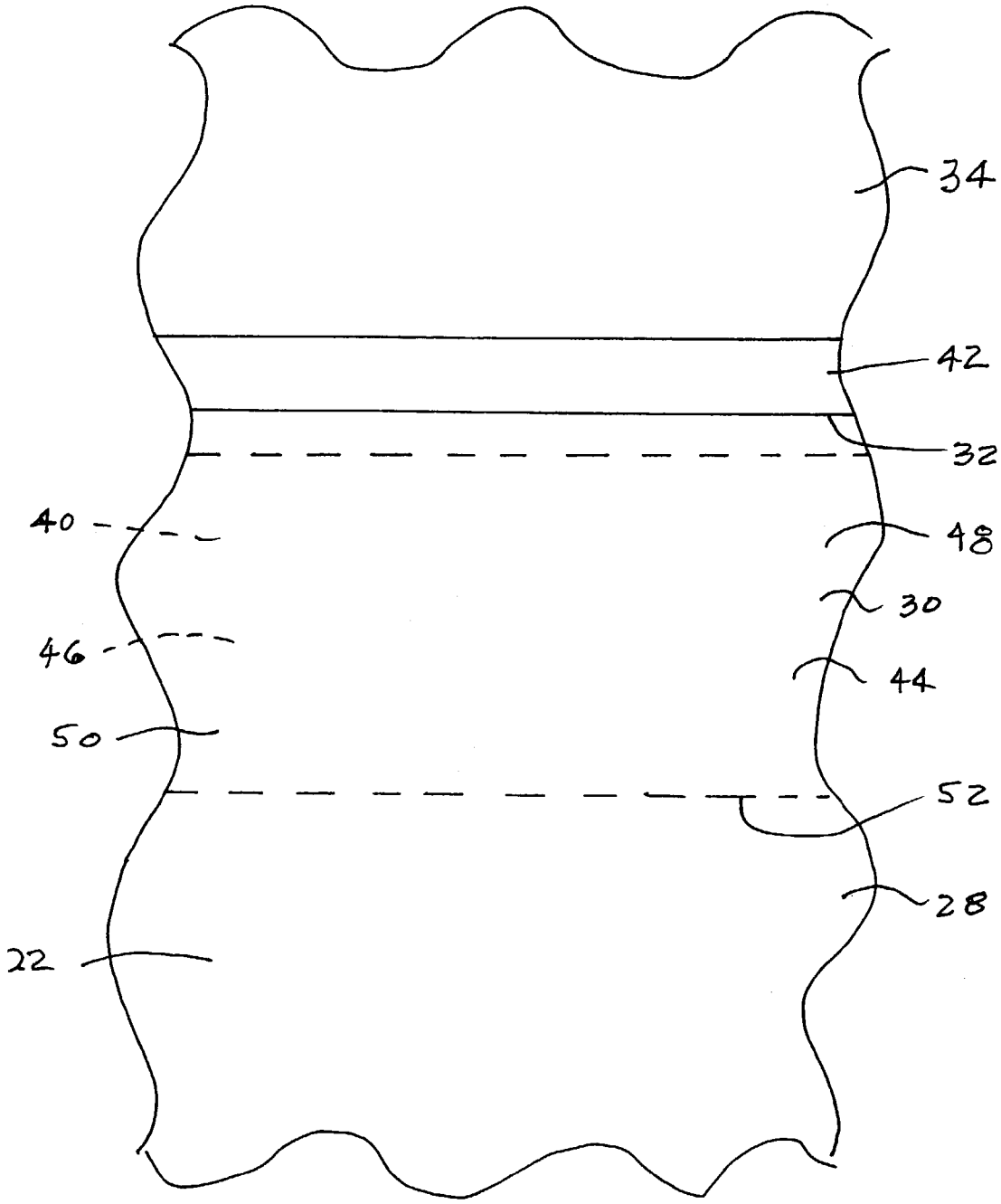
FIG. 4 is a fragmentary front elevational view looking toward the left in FIG. 3B and therefore illustrating the horizontal projection of the wall of the tank of FIG. 3B.

In accordance with the invention, lining 34 desirably includes a lower attachment portion 40. As can be seen from FIGS. 2 and 3B, the lower attachment portion 40 of the lining 34 and the upper attachment segment 30 of waterstop structure 22 are disposed in overlapping relationship, preferably with the upper attachment segment 30 of waterstop structure 22 overlying the lower attachment portion 40 of the lining 34 to provide access and facilitate further construction. The upper edge 32 of the waterstop structure 22 is preferably attached in a sealing relationship to the lining 34 by welding or the like to present a horizontally elongated sealed joint in the form of a plastic weld bead 42. With particular reference to FIG. 4 it can be seen that weld bead 42 extends along the upper edge 32 of water stop 22 in a lateral direction across lining 34. Although bead welding is the preferred method for attaching the upper edge 32 of the waterstop structure 22 a sealing relationship to the lining 34, alternative methods within the scope of the invention include integrally connecting the upper edge 32 of the waterstop structure 22 to the lining 34 using a mechanical welding device that applies heat and pressure to the two materials to bond the materials at their interface, integrally connecting the upper edge 32 of the waterstop structure 22 to the lining 34 using a hand held hot gas welding device and hand rolling the waterstop onto the lined walls, integrally connecting the upper edge 32 of the waterstop structure 22 to the lining 34 using an adhesive and integrally connecting the upper edge 32 of the waterstop structure 22 to the lining 34 using a tape.

Figure 3A:
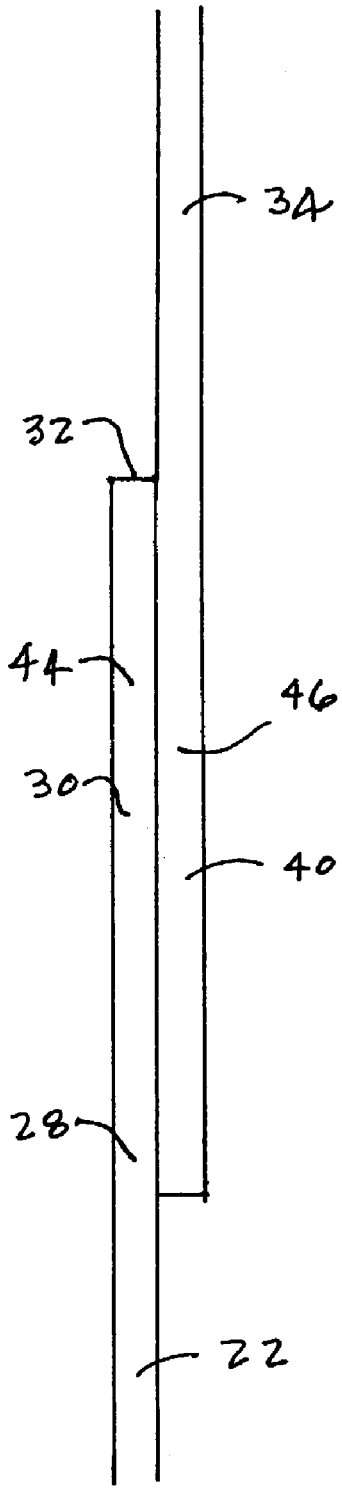

In still further accordance with the concepts and principles of the invention, an area 44 of the upper attachment segment 30 of waterstop structure 22 is interconnected with an area 46 of the lower attachment portion 40 of the lining 34 to thereby form a supporting structure 48 in the form of a horizontally extending stiffened band 50 which is located at a position that is lower on wall 14 than weld bead 42. Band 50 is the area shown between the dashed lines in FIG. 4. With reference to FIGS. 3A and 3B, this interconnection may desirably be accomplished by placing the upper attachment segment 30 over the lower attachment portion 40 as shown in FIG. 3A, and applying heat and pressure to the outside of segment 30 so as to fuse the plastic materials at areas 44 and 46 and thereby present the supporting structure 48 as shown in FIG. 3B. Depending upon the circumstances of the application, the band 50 may have a substantial vertical width which may desirably range from about ½ inch to about 6 inches.

The band 50 provides a stiffened, bending resistant structure which inhibits outward bending of the flange 28 relative to the lining 34 at the weld bead 42 and promotes outward bending of the flange 28 relative to the lining 34 at the lower extremity 52 of the band 50. Thus, wear and tear on the weld bead 42 during shifting of the wall relative to the floor is minimized. This action is illustrated by FIGS. 5A and 5B.

As is well known to those skilled in the art, waterstop structure 22 may also include a flexible curved segment 53 interconnecting the flange 28 and the anchor 25 to accommodate movement and elongation of the waterstop structure 22 during movement of the wall 14 relative to the floor 12.

Figure 5B:
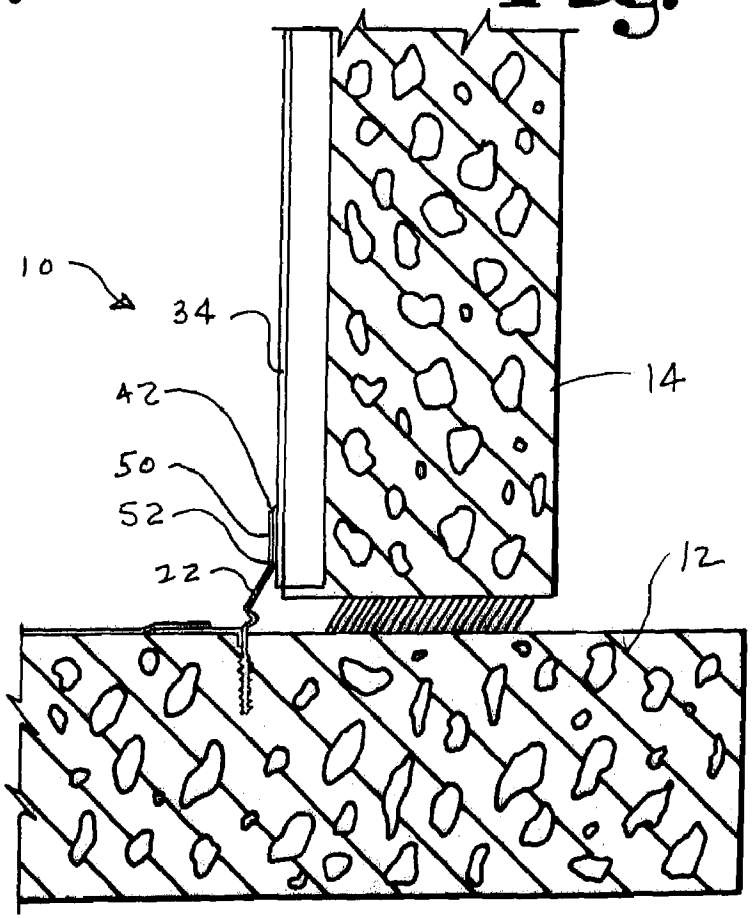
FIGS. 5A and 5B are elevational cross-sectional views similar to FIGS. 1A and 1B but instead illustrating the operation the waterstop and tank of FIG. 2.
Figure 5A:
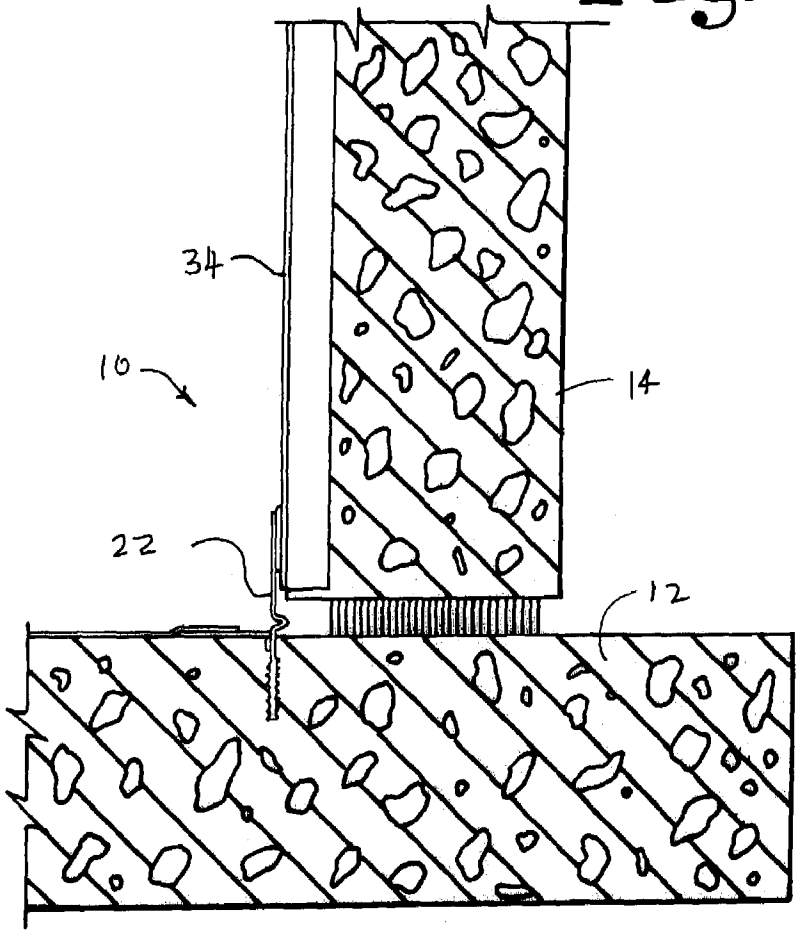

The action of the waterstop structure 22 in accordance with the concepts and principles of the invention is illustrated in FIGS. 5A and 5B. FIG. 5A shows the waterstop structure 22 in its neutral unstressed condition while FIG. 5B shows the waterstop structure 22 in a stressed condition. As can be seen, when the waterstop structure is in the FIG. 5B stressed condition, the flange 28 is bent away from the lining 34 at the lower extremity 52 of the band 50 and the weld bead 42 is in an unstressed condition.

To further prevent leakage from the tank 10, and as best shown in FIG. 2, the tank 10 may be provided with a plastic floor liner 54 on the upper surface of floor 12 and a floor liner attachment member 56. The floor liner 54 desirably includes a lateral attachment portion 58. Furthermore, the attachment member 56 desirably includes a horizontally extending tab section 60 having a distal edge portion 62 and a preferably downwardly extending connector flap 64. The floor liner attachment member 56 may desirably be attached in sealing relationship to the tab section 60 by welding or the like so as to present a weld bead 66. A sector 68 of connector flap 64 may be attached to a sector 70 of the lower portion 26 of the anchor 25 by fusion or by welding. As can also be seen from FIG. 2, it is desirable that the sectors 68 and 70 be positioned such that the same are embedded in the concrete beneath the upper surface of floor 12 as it is being poured.

The waterstop structure 22 may be cast into or otherwise fastened to the concrete floor 12 of the tank 10 which supports the plastic-lined wall panels 14. The waterstop structure 22 is then welded to the plastic-lined concrete wall panels 14 that are either precast and lifted into place or shotcreted or cast in place.

In accordance with the invention, a supporting structure that is protective of the waterstop/lining seal of a lined tank is provided which may be produced from the tank side of the wall, which is generally 100% effective in holding the waterstop to the panel lining and which isolates the primary seal from any movement of the walls relative to the floor of the tank.

The waterstop structure 22 may desirably be formed from a thermoplastic material, such as, for example, polyvinylchloride (PVC), High Density Polyethylene (HDPE), Linear Low Density Polyethylene (LLDPE), Very Low Density Polyethylene (VLDPE), Polypropylene (PP), non-specific thermoplastic rubber or a combination of these materials. The main concern here is that the material be sturdy and strong enough to remain undamaged and resilient for an appropriate number of years during flexing and shifting of the wall 14 relative to floor 12. Ideally, the material used should also have sufficient the chemical resistance to contain, along with the wall lining 34 and floor liner 54, whatever substance may be contained in the tank. Desirably, the wall lining 34 and the floor liner 54 may each be formed from these same materials. Preferably and desirably, the wall lining 34 and/or the floor liner 54, as the case may be, should be formed from the same material as the waterstop structure 22 to insure that the materials melt and fuse under essentially identical conditions of temperature and pressure. This insures the provision of an adequate seal.

Thus it can be seen that through the use of the waterstop structure 22 in combination with the attachment member 56, an appropriate seal may be provided between both a plastic wall lining 34 and a plastic floor liner 54.

We claim:

1. A plastic lined concrete tank comprising a floor, a horizontally elongated upright wall having a lower edge disposed adjacent said floor, said wall being relatively shiftable in a generally horizontal direction relative to said floor, a plastic wall lining disposed on an interior surface of the wall, and a horizontally elongated plastic waterstop structure disposed to extend upwardly between the floor and said wall lining for inhibiting penetration of water between said floor and said lower edge of the wall, said waterstop structure being resistant to damage during shifting of the wall relative to the floor and comprising:

an anchor attached to said floor adjacent said wall; and a flange extending upwardly from the anchor, said flange including an upper attachment segment, said upper attachment segment of the flange and a lower attachment portion of the lining being disposed in overlapping relationship relative to one another, said upper attachment segment having an upper edge attached in sealing relationship to said wall lining so as to present an elongated sealed joint which extends along said upper edge in a lateral direction across the wall lining;

an area of a surface of said upper attachment segment and a facing area of a surface of said lower attachment portion being interconnected to form a supporting structure at a position lower on the wall than the sealed joint, whereby outward bending of the flange away from the wall lining at said joint during shifting of the wall relative to the floor is inhibited and outward bending of the flange away from the wall lining at a location remote from said joint during shifting of the wall relative to the floor is promoted.

2. A plastic lined concrete tank as set forth in claim 1, wherein said upper attachment segment of the flange is disposed in overlying relationship relative to said lower attachment portion of the wall lining, said surface of said upper attachment segment is an inner surface, and said surface of said lower attachment portion is an outer surface.

3. A plastic lined concrete tank as set forth in claim 1, wherein a portion of said anchor is embedded in said floor.

4. A plastic lined concrete tank as set forth in claim 1, wherein support structure comprises a bending resistant horizontally extending band having a substantial vertical width.

5. A plastic lined concrete tank as set forth in claim 4, wherein said band has a vertical width ranging from about ½ inch to about 6 inches.

6. A plastic lined concrete tank as set forth in claim 1, wherein said support structure is formed by fusing together plastic materials of the upper attachment segment of the flange and the lower attachment portion of the wall lining.

7. A plastic lined concrete tank as set forth in claim 4, wherein said support structure is formed by fusing together plastic materials of the upper attachment segment of the flange and the lower attachment portion of the wall lining.

8. A plastic lined concrete tank comprising a floor, a horizontally elongated upright wall having a lower edge disposed adjacent said floor, a plastic wall lining disposed on an interior surface of the wall, and a horizontally elongated plastic waterstop structure inhibiting penetration of water between said floor and said lower edge of the wall, said waterstop structure comprising:

an anchor attached to said floor adjacent said wall;

an upwardly extending flange including an upper attachment segment, said upper attachment segment of the flange and a lower attachment portion of the lining being disposed in overlapping relationship relative to one another, said upper attachment segment having an upper edge attached in sealing relationship to said wall lining so as to present an elongated sealed joint comprising a horizontally elongated plastic weld bead which extends along said upper edge in a lateral direction across the wall lining; and an area of a surface of said upper attachment segment and a facing area of a surface of said lower attachment portion being interconnected to form a supporting structure at a position lower on the wall than the sealed joint, whereby outward bending of the flange away from the wall lining at said joint during shifting of the wall relative to the floor is inhibited and outward bending of the flange away from the wall lining at a location remote from said joint during shifting of the wall relative to the floor is promoted.

9. A plastic lined concrete tank as set forth in claim 7, wherein said support structure comprises a bending resistant horizontally extending band having a substantial vertical width formed by fusing together plastic materials of the upper attachment segment of the flange and the lower attachment portion of the wall lining.

10. A plastic lined concrete tank as set forth in claim 1, including a plastic floor liner on an upper surface of the floor and a floor liner attachment member connected to said anchor, said attachment member including a generally horizontally extending tab section having a distal edge portion attached in sealing relationship to a lateral attachment portion of the floor liner.

11. A plastic lined concrete tank as set forth in claim 9, including a plastic floor liner on an upper surface of the floor and a floor liner attachment member connected to said anchor, said attachment member including a generally horizontally extending tab section having a distal edge portion attached in sealing relationship to a lateral attachment portion of the floor liner.

12. A plastic lined concrete tank comprising a generally horizontal floor, a horizontally elongated upright wall having a lower edge disposed adjacent said floor, said wall being relatively shiftable in a generally horizontal direction relative to said floor, a plastic wall lining disposed on an interior surface of the wall, a plastic floor liner disposed on an upper surface of the floor, and a horizontally elongated plastic waterstop structure disposed to extend upwardly between the floor and said wall lining for inhibiting penetration of water between said floor and said lower edge of the wall, said waterstop structure being resistant to damage during shifting of the wall relative to the floor and comprising:

an anchor attached to said floor adjacent said wall;

a flange extending upwardly from the anchor, said flange including an upper attachment segment attached in sealing relationship to a lower attachment portion of the wall lining; and a floor liner attachment member connected to said anchor, said attachment member including a generally horizontally extending tab section having a distal edge portion attached in sealing relationship to a lateral attachment portion of the floor liner.

13. A plastic lined concrete tank as set forth in claim 11, wherein a portion of said anchor is embedded in said floor.

14. A plastic lined concrete tank as set forth in claim 12, wherein a portion of said anchor is embedded in said floor.

15. A plastic lined concrete tank as set forth in claim 11, wherein said attachment member includes a connector flap that is attached to said anchor.

16. A plastic lined concrete tank comprising a generally horizontal floor, a horizontally elongated upright wall having a lower edge disposed adjacent said floor, a plastic wall lining disposed on an interior surface of the wall, a plastic floor liner disposed on an upper surface of the floor, and a horizontally elongated plastic waterstop structure inhibiting penetration of water between said floor and said lower edge of the wall, said waterstop structure comprising:

an anchor attached to said floor adjacent said wall;

an upwardly extending flange including an upper attachment segment attached in sealing relationship to a lower attachment portion of the wall lining; and a floor liner attachment member connected to said anchor, said attachment member including a generally horizontally extending tab section having a distal edge portion attached in sealing relationship to a lateral attachment portion of the floor liner, said attachment member including a connector flap that is attached to said anchor.

17. A plastic lined concrete tank comprising a floor, a horizontally elongated upright wall having a lower edge disposed adjacent said floor, a plastic wall lining disposed on an interior surface of the wall, and a horizontally elongated plastic waterstop structure inhibiting penetration of water between said floor and said lower edge of the wall, said waterstop structure comprising:

an anchor attached to said floor adjacent said wall;

an upwardly extending flange including an upper attachment segment, said upper attachment segment of the flange and a lower attachment portion of the lining being disposed in overlapping relationship relative to one another, said upper attachment segment having an upper edge attached in sealing relationship to said wall lining so as to present an elongated sealed joint which extends along said upper edge in a lateral direction across the wall lining, an area of a surface of said upper attachment segment and a facing area of a surface of said lower attachment portion being interconnected to form a supporting structure at a position lower on the wall than the sealed joint, whereby outward bending of the flange away from the wall lining at said joint during shifting of the wall relative to the floor is inhibited and outward bending of the flange away from the wall lining at a location remote from said joint during shifting of the wall relative to the floor is promoted; and a plastic floor liner on an upper surface of the floor and a floor liner attachment member connected to said anchor, said attachment member including a generally horizontally extending tab section having a distal edge portion attached in sealing relationship to a lateral attachment portion of the floor liner, wherein said attachment member includes a connector flap that is attached to said anchor.

18. A plastic lined concrete tank as set forth in claim 15, 16 or 17, wherein said connector flap extends downwardly from said horizontally extending tab.

19. A plastic lined concrete tank as set forth in claim 18 wherein a sector of said connector flap is fused to a corresponding sector of the anchor.

20. A plastic lined concrete tank as set forth in claim 19 wherein said sectors are embedded in the floor.

21. A method for sealing a plastic lined concrete tank comprising a generally horizontal floor, a horizontally elongated upright wall, said wall being relatively shiftable in a generally horizontal direction relative to said floor, and a plastic wall lining disposed on an interior surface of the wall, said method comprising:

providing an elongated plastic waterstop structure including an anchor and a flange;

positioning the waterstop structure so that it extends upwardly between the floor and said wall lining with the flange extending upwardly from the anchor, said flange having an upper attachment segment presenting an upper edge;

attaching said anchor to said floor adjacent said wall;

installing the upper attachment segment of the flange such that it and a lower attachment portion of the lining are disposed in overlapping relationship;

sealing the upper edge of the upper attachment segment to said wall lining so as to present an elongated sealed joint which extends along said upper edge in a lateral direction across the wall lining; and interconnecting an area of a surface of said upper attachment segment and a facing area of a surface of said lower attachment portion to form a supporting structure at a position lower on the wall than the sealed joint, whereby outward bending of the flange away from the wall lining at said joint during shifting of the wall relative to the floor is inhibited and outward bending of the flange away from the wall lining at a location remote from said joint during shifting of the wall relative to the floor is promoted.

22. A method for sealing a plastic lined tank as set forth in claim 21, wherein said upper attachment segment of the flange is installed in overlying relationship relative to said lower attachment portion of the lining, said surface of said upper attachment segment is an inner surface, and said surface of said lower attachment portion is an outer surface.

23. A method for sealing a plastic lined concrete tank comprising a generally horizontal floor, a horizontally elongated upright wall, and a plastic wall lining disposed on an interior surface of the wall, said method comprising:

providing a waterstop structure including an anchor and an upwardly extending flange having an upper attachment segment presenting an upper edge;

attaching said anchor to said floor adjacent said wall;

installing the upper attachment segment of the flange such that it and a lower attachment portion of the lining are disposed in overlapping relationship;

sealing the upper edge of the upper attachment segment to said wall lining so as to present an elongated sealed joint which extends along said upper edge in a lateral direction across the wall lining; and interconnecting an area of a surface of said upper attachment segment and a facing area of a surface of said lower attachment portion to form a supporting structure at a position lower on the wall than the sealed joint, whereby outward bending of the flange away from the wall lining at said joint during shifting of the wall relative to the floor is inhibited and outward bending of the flange away from the wall lining at a location remote from said joint during shifting of the wall relative to the floor is promoted, wherein said supporting structure is formed by fusing together the plastic materials of the flange and the plastic materials of the lining.

24. A method for preventing bending along a horizontal sealed joint between (1) a plastic lining on an upright wall of a concrete tank, which wall sits by and shifts generally horizontally relative to a floor during use and (2) an upright flange of an elongated plastic waterstop, said method comprising:

providing a lower attachment portion on said plastic lining beneath said joint;

positioning said waterstop between said floor and said plastic lining so that said flange extends upwardly into overlapping relationship relative to said lower attachment portion; and interconnecting an area of said attachment portion to an area of an upper attachment segment of said flange to form a supporting structure at a position lower than said joint, whereby said flange bends at a location adjacent a lower edge of said supporting structure rather than at said joint during shifting of the wall.

25. A method for preventing bending as set forth in claim 24, wherein said upper attachment segment of said flange initially overlies said lower attachment portion of said plastic lining.

26. A method for preventing bending along a horizontal sealed joint between a plastic lining on a wall of a tank which shifts during use and an upright flange of a plastic waterstop comprising:

providing a lower attachment portion on said plastic lining beneath said joint; and interconnecting an area of said attachment portion to an area of an upper attachment segment of said flange bends at a location adjacent a lower edge of said supporting structure rather than at said joint during shifting of the wall, wherein said supporting structure is formed by fusing together the plastic materials of the flange and the plastic materials of the lining.

* * * * *

UNITED STATES PATENT AND TRADEMARK OFFICE

CERTIFICATE OF CORRECTION

PATENT NO. : 7,111,751 B2
APPLICATION NO. : 10/457721
DATED : September 26, 2006
INVENTOR(S) : Copley et al.

It is certified that error appears in the above-identified patent and that said Letters Patent is hereby corrected as shown below:

Column 8,
Line 46, delete "7" and insert -- 8 -- therefor.

Column 12,
Line 22, insert --to form a supporting structure at a position lower than said joint, whereby said flange-- after "flange".

Signed and Sealed this

Tenth Day of April, 2007

JON W. DUDAS
*Director of the United States Patent and Trademark Office*